United States Patent [19]

Bouvard et al.

[11] 4,181,905

[45] Jan. 1, 1980

[54] QUICK RELEASE CONNECTOR FOR WAVEGUIDE CIRCUITS

[75] Inventors: André Bouvard; Jean-René Mahieu, both of Paris, France

[73] Assignee: Societe Lignes Telegraphiques et Telephoniques, Paris, France

[21] Appl. No.: 918,651

[22] Filed: Jun. 23, 1978

[30] Foreign Application Priority Data

Jul. 21, 1977 [FR] France ..... 77 22336

[51] Int. Cl.[2] ..... H01P 1/00

[52] U.S. Cl. ..... 333/255; 333/260

[58] Field of Search ..... 333/248, 254, 255, 257, 333/260, 261

[56] References Cited

U.S. PATENT DOCUMENTS 3,229,234 1/1966 Lattanzi ..... 333/261

*Primary Examiner*—Alfred E. Smith
*Assistant Examiner*—Robert E. Wise
*Attorney, Agent, or Firm*—Kemon & Estabrook

[57] ABSTRACT

Quick release interconnection of waveguide circuits terminated at least partially by a standard flange is achieved by rotation of a clamping ring which surrounds the first circuit termination and cooperates by means of outer grips with a groove in a base mounted on the second circuit. Tight engagement is obtained by means of protruding pins carried by a sleeve fastened to the first circuit guided by semicircular cams and locked in a recess in inclined spring guides carried by the inner face of the rotatable ring. Disengagement is obtained by rotating the ring counterwise. Fool proof interconnection is obtained by a unique means protruding from the standard flange and registering with a unique recess in said base.

6 Claims, 7 Drawing Figures

QUICK RELEASE CONNECTOR FOR WAVEGUIDE CIRCUITS

BACKGROUND OF THE INVENTION AND PRIOR ART

The present invention concerns connecting waveguide circuits with rectangular cross section such as used at millimetric wavelength.

The constantly increasing development of communications has led to the use of millimetric electromagnetic waves as a carrier for information and of waveguides as a means for transmission. Repeaters are necessary for compensating for the attenuation along the waveguides. Maintenance during operation may involve replacement of certain circuits. Demounting and reassembling the circuits are carried out by connecting the terminal flanges of the waveguides, they call for care and involve traffic interruptions which should be minimized.

Known devices for quick release connection of waveguides terminated by circular flanges comprise a two part clamping collar. One example thereof is disclosed in French Patent No. 2,134,176 filed on Apr. 23rd, 1971 by Cables de Lyon-Alsacienne-Geoffroy-Delore. The device described in this patent as applicable to two flanges each having an inclined face, is unsuitable for standard flanges with no perpendicular parts. The German application 2,035,421 filed on July 16th, 1970 by Siemens, discloses a device for quick interconnecting waveguides terminated by rectangular flanges. This device is limited to clamping already positioned waveguides, and in addition it occupies a space outside the flange which is rarely available in repeaters or associated equipment.

The connecting device according to the invention has for its object to make it possible for two waveguide circuits to be precisely positioned in relation to one another in a quasi-automatic manner without modification to the standard flanges.

BRIEF DISCLOSURE OF THE INVENTION

The device for interconnecting a first circuit comprising a first waveguide section terminated by a standard flange with a second circuit comprising a second waveguide section terminated by a flange associated with a fixed circular base according to the invention is characterized in that:

the said first waveguide section is surrounded by a cylindrical sleeve having the same axis as the flange, to which it is fixed, the said sleeve having three pins at 120 degrees in a plane perpendicular to the said axis projecting from its lateral face;

a movable ring surrounding the said sleeve has mounted on its inside wall three rods consisting of spring steel, which are inclined substantially at 70 degrees to the axis of the flange and which are fixed at each end and each has a slot for the engagement of one of the said pins, three fixed projecting cams of a sufficient width to serve as a bearing means for the said pins, the said three cams being disposed at a distance from the said steel rods to permit the passage of the pins, and in its portion closest to the flange three equidistant grips;

and in that the said flange terminating the said second wave guide section supports on its forward face the said fixed base which has a circular groove into which three grips mounted on the movable ring will engage through three apertures situated at 120 degrees from one another.

The connecting device just described is applicable to two circuits, one of which is terminated by a standard waveguide section comprising a standard flange, while the other has a plane terminal face of sufficient extent to receive the fixed circular base. When the first of the circuits is terminated by a waveguide section machined in a metal block associated to a standard flange, the sleeve is made in two parts which are assembled on the flange. When the two circuits are each terminated by a standard wave guide section comprising a standard flange, the fixed circular base is mounted on a plate surrounding one of the flanges.

The device according to the invention has a number of advantages:

the presence of three identical cams at 120 degrees for displacing one of the circuits in relation to the other through a translational movement along the common axis of the flanges mounted thereon avoids deformation of the centering pins and increases the number of assembling and demounting operations which can be tolerated without any change in the insertion loss;

the locking of the studs on completion of the assembly applies the two flanges one on to the other in reproducible manner and maintains the insertion loss at a negligible value;

no modification of the flanges nor the waveguides is required.

BRIEF DESCRIPTION OF THE FIGURES

The following description is accompanied by FIGS. 1 to 7 which are given by way of non limiting illustration and in which.

DETAILED DESCRIPTION OF THE FIGURES

In order to facilitate the reference to the various figures, the cross section of the associated waveguide has been represented by the chain-lined rectangle a b c d, wherever permitted by the view.

Figure 1:
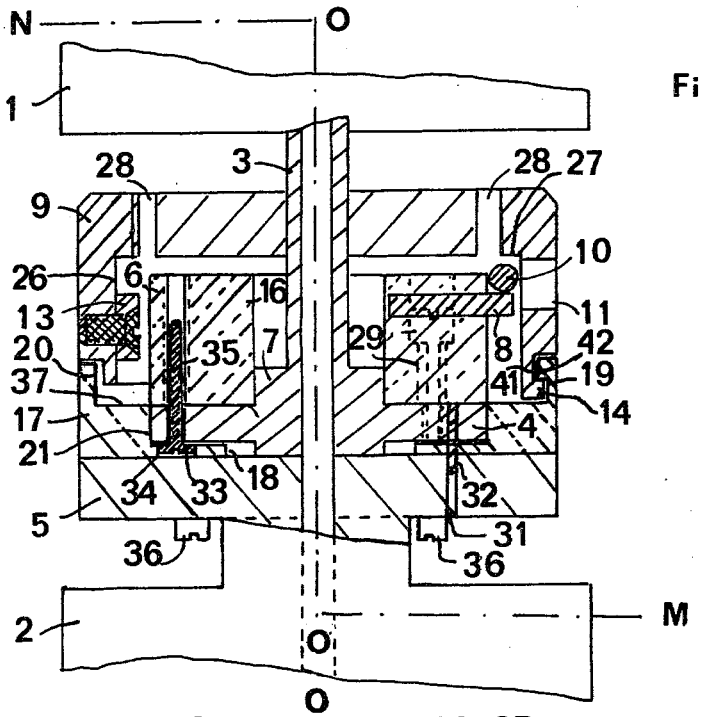
FIG. 1 represents the assembly of two circuits by means of the device according to the invention in section along the planes containing the axis of the device and represented by NOM in FIGS. 3 and 4.
Figure 3:
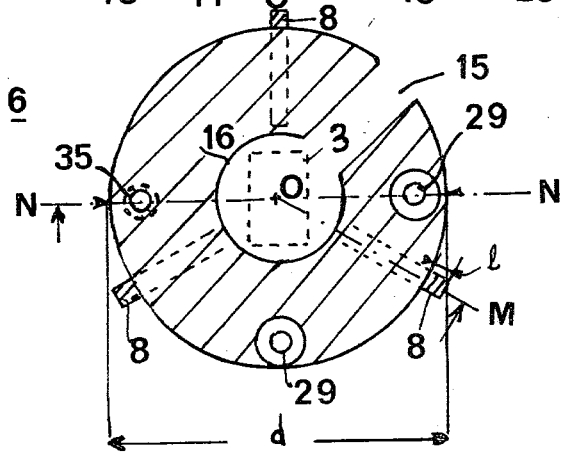
FIG. 3 is an overhead view of the sleeve associated with the movable ring.
Figure 4:
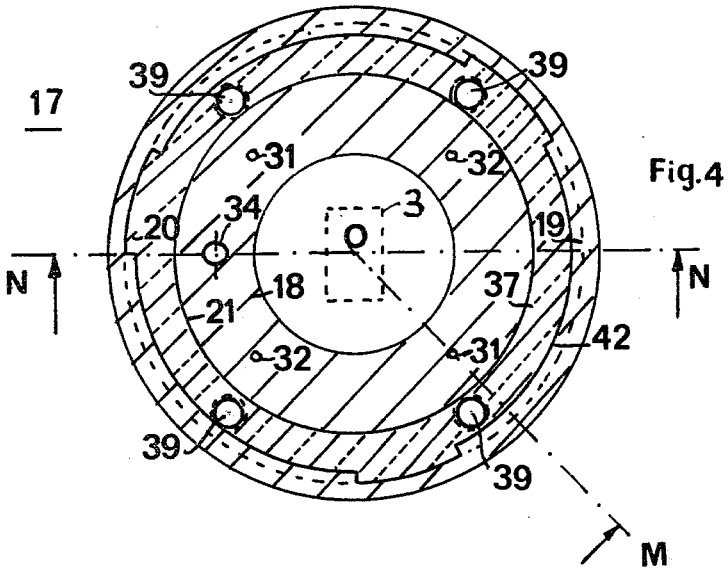
FIG. 4 is an overhead view of the fixed circular base.

FIG. 1 is a turned down half section along the planes containing the axis as represented by the lines ON, OM in FIGS. 3 and 4 showing the two circuits 1 and 2 assembled by means of the connecting device according to the invention. The circuit 1 is terminated by a standard waveguide section 3 terminated by a standard flange 4. The circuit 2 is terminated by a plane flange 5. Guide 3 is surrounded by a sleeve 6 the inner bore 16 of which rests on the shoulder 7 of the flange 4 to which it is fixed. The outer diameter of 6 is almost equal to that of flange 4. Sleeve 6 is machined with two holes 29 and a threaded hole 35 (cf. FIG. 3) which register with holes for fixing standard flange 4 as shown on the left hand side of the figure. Screw 33 secures 6 and 4. Its head is lodged in a hole 34 in base 17. One hole 29 in the part of sleeve 6 at the rear of the section plane is shown by interrupted lines on the right hand part of FIG. 1. Sleeve 6 has an outer diameter d.

It carries three steel pins 8 forced into the sleeve in holes at 120 degrees from one another (FIG. 3) which protrude by a length $\rho$ from the sleeve. One only of these pins is visible in FIG. 1.

A rotatable clamping ring 9 of revolution around axis 00 has an inner bore 26 of diameter equal to $d+2\rho+\epsilon$ where $\epsilon$ is small with respect to $\rho$. The upper part of ring 9 is terminated by an inward thickened wall 27 of inner diameter equal to $d+\epsilon$ so as to allow for the passage of sleeve 6. The inner part of the wall 27 is machined with three vertical grooves 28 120 degrees apart of a thickness equal to $\rho+(\epsilon/2)$ and a width matching the dimensions of pins 8. The thin wall of ring 9 is machined with three openings 11 (FIGS. 1 and 2) 120 degrees apart. The inner part of ring 9 carries three steel spring guiding parts 10 near openings 11. One of such guiding parts is cut on the right hand part of FIG. 1. It can be seen in full in FIG. 2. When the connection is locked (cf. FIG. 1) each guide 10 rests on the protruding part of one pin 8 of sleeve 6. On the left hand side of FIG. 1, one of the three cams 13 fixed to the inner bore 26 can be seen in cut while another one is shown in front view in FIG. 2. Cam 13 penetrates inside the inner bore 26 by a length e shorter than $\rho$ so that pins 8 can slide on cams 13 during the rotation of ring 9. Near its lower end, the outer wall of ring 9 bears a groove 41 which matches the upper ridge 42 in base 17. At the lower end of ring 9, three grips 14 120 degrees apart match groove 19 in base 17. One flange 5 is set a circular base 17 (cf. FIG. 4). The lower face of base 17 is machined with four apertures such as 31 at the left hand side in FIG. 1 for the centering pins 32 of standard flange 4. Furthermore, the plate is equipped with a lodging 34 for the head of symmetry breaking screw 33. Base 17 is continued by a thickened intermediate outer ring delimiting a bore 21 having the diameter of flange 4 (with usual mechanical play) and the same thickness as the flange. Base 17 is terminated by a second outer ring which delimits a bore 20. The shoulder 37 between these rings is machined with holes 39 for screws (such as 36) for securing flange 5 to the base 17. The inner face of the upper ring is machined with a circular groove 19 located just above the plane of shoulder 37. Above groove 19 the base is terminated by an inward ring 42 in which three recesses 20 are managed for allowing grips 14 of rotatable ring 9 to penetrate into groove 19.

Figure 2:
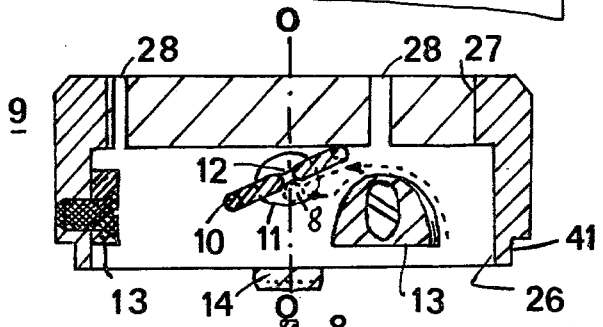
FIG. 2 is a sectional view of the movable ring of the device according to the invention in the plane containing the axis represented by NON in FIGS. 3 and 4.

FIG. 2 shows a more detailed view of guiding parts 10 as carried by the rotatable ring 9 thanks to the removal of waveguide 3 from this view. Each guiding part is provided with a central notch 12 in which one of the pins 8 will nest when interconnection is locked. The extremities of the guides are bent at 90° with respect to the linear part shown in the figure and forced in holes provided on both sides of the opening 11 in ring 9. Once locked guides 10 leave enough room for sleeve 6 when ring 9 is positioned. FIG. 2 shows also a second cam 13 mounted inside ring 9, 120 degrees apart from the one seen in section. As shown the distance between guide 10 and the nearest cam is reduced but larger than the diameter of pins 8. Thereby when ring 9 is rotated, the pins will pass between the cams and the guides resting successively on each as shown by the dotted arrows.

FIG. 3 is a top view of sleeve 6. A radial slot 15 is provided for introducing sleeve 6 around waveguide 3. Bore 16 is intended for centering purpose with respect to flange 4. The other parts have already been mentioned.

FIG. 4 is a top view of base 17. Openings 39 are provided for setting base 17 on flange 5 by means of screws 36. External groove 19 and the recesses 20 in the upper ring 42 have already been described. The inner flat 18 carries two centering pins 32 and two openings 31 in which will fit the centering pins of the matching flange as is current practice.

Connecting waveguide 1 to waveguide 2 is performed as follows: waveguide 1 is equipped with sleeve 6 and rotatable ring 9, waveguide 2 is equipped with annular base 17, the two waveguides are positioned face to face, the grips 14 of the rotatable ring 9 are introduced into the recesses 20 in the base 17. The grips 14 can be positioned in the recesses 20 at three different positions at 120 degrees to one another, but only the correct position permits further engagement into the recesses 20 due to the presence of screw 33 cooperating with recess 34 and the following steps. When incorrectly positioned, the penetration of the grips 14 into the recesses 20 is interrupted as soon as the screw 33 abuts shoulder 18. After correct positioning, the strips 14 can further engaged in the recesses 20, rotation of ring 9 is the clockwise direction engages the grips 14 in groove 19. The pins 8 pass over the cams 13 and bear on the guides 10, the slope of which imparts a translational movement to the waveguide 1 towards the waveguide 2 and the centering pins 32 of the flange 4 register with the recesses 31 in the flange 5. The end of the rotation is marked by the catching of the pins 8 in the notches 12 in guides 10. For release of the connection 2, it is sufficient to rotate ring 9 counterclockwise from the position just described. After disengagement, the pins 8 come into contact with the cams 13 and produce a translational movement along the axis of the waveguides away from another in order to disengage the centering pins 32 from the apertures 31 corresponding thereto. Thereafter, the cams 13 are retracted; the disengagement of the grips 14 through the apertures 20 is then possible. The two circuits are made independent.

By way of non limiting illustration, a connecting device according to the invention has been designed for standard RG 97/U waveguide sections. The waveguide of one of the circuits is terminated by a flange UG 383/U, while the waveguide section of the other circuit is terminated by a rectangular plane flange measuring 40×32 mm. The rectangular flange has apertures intended to receive the centering pins of the flange UG 383/U serving to orient the waveguide sections in relation to one another, so as to ensure continuity of the wave propagation guide. Rotation of ring 9 is about 45 degrees for connection. Insertion loss due to the connection is too low to be measured.

Figure 5:
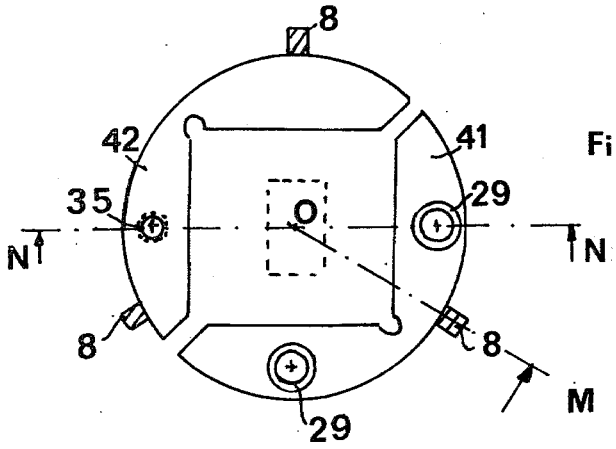
FIG. 5 illustrates a modified form of the sleeve associated with the movable ring.

FIG. 5 illustrates a modified form of the cylindrical sleeve 6. When the waveguide section 3 of circuit 1 is machined from a metal block, the external section usually adopted is that of a square. The unitary cylindrical sleeve 6 is replaced by a two part sleeve 41–42 in accordance with FIG. 5, assembled around the waveguide section by mounting on flange 4 by means of screws threading through 29 and 35. Flange 40 is surrounded with a setting plate 23 for base 17 which is centered by means of shoulder 38 in the flange which cooperates with bore 25. Plate 23 is fastened with flange 40 by means of four screws 45 in holes registering with the approved threaded holes.

Figure 6:
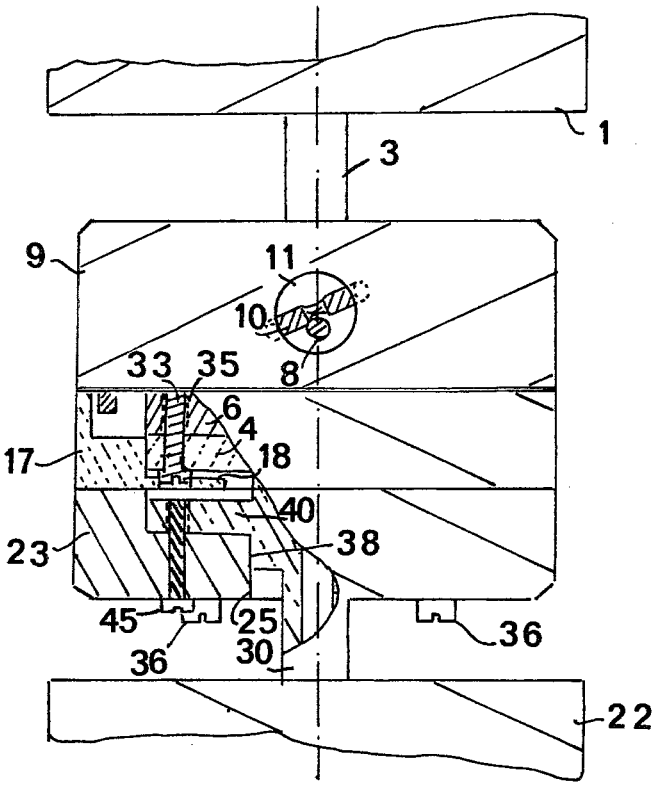
FIG. 6 illustrates the assembly of two circuits each terminated by a standard waveguide terminated by an approved flange, in side view.

FIG. 6 is a part-sectional view of the assembly of two circuits 1 and 22 each comprising a waveguide section respectively 3 and 30, each terminated by a standard flange, respectively 4 and 40. A partial section of FIG. 6 shows the head of screw 33 lodged in aperture 34 in the base 17. The body of screw 33 occupies an aperture 35 in sleeve 6. FIG. 6 also shows a face view of one of the three apertures 11 in ring 9, through which a guide rod 10 and a pin 8 can be seen. All that has been described with reference to FIG. 1, the rotatable ring 9 and the base 17 remains unchanged.

Figure 7:
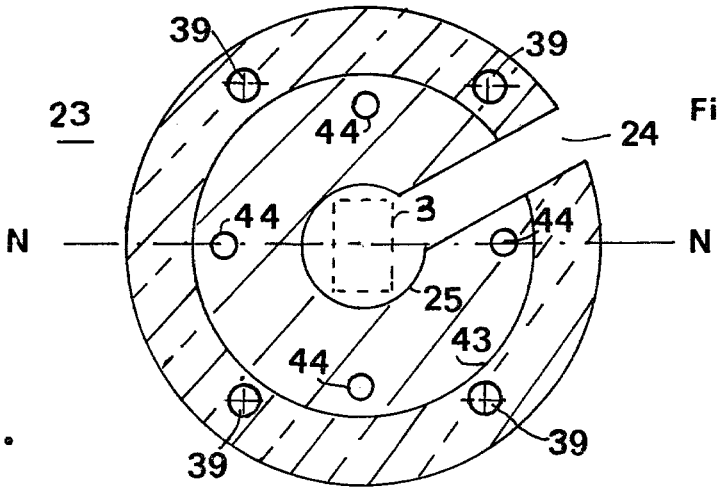
FIG. 7 is an overhead view of a fixing plate for the circular base.

FIG. 7 illustrates mounting plate 23 as seen from above. A slot 24 permits the positioning of the plate around flange 40. A bore 25 having the same diameter as the shoulder 37 of the flange 40 ensures the centering of the plate 23 in relation to the flange 40. The four holes 44 serve for screwing the plate to flange 40; the four holes 39 serve for screwing to the base 17.

What we claim:

1. A releasable interconnection for two waveguide circuits comprising a rotatable ring mounted around a first waveguide circuit terminated by a standard flange and a fixed base solid with the second waveguide circuit matching said ring in which:

said first waveguide circuit is surrounded by a cylindrical sleeve coaxial with the waveguide and fastened to said flange carrying three radial protruding pins 120 degrees apart, said sleeve being disposed inside said ring said ring carries on its inside a first set of three steel spring rodlike guides set at both ends in said ring 120 degrees apart and inclined at 70° on the axis of the ring provided with an interlocking central groove matching the dimensions of the section of said pin and a second set of three semicircular cams 120° degrees apart which cooperate with said pins during rotation of said ring so that said pins will pass between said guides and cams, said ring being provided at its lower end with three externally protruding grips 120 degrees apart said base is provided at its upper end with an inner circular groove in which said grips can penetrate through three apertures means for preventing false relative positioning of said waveguides in both said terminating flanges.

2. A releasable interconnection for two waveguide circuits according to claim 1 in which said means for preventing false relative positioning consists in the head of a screw threaded into the face of the flange of said first waveguide circuit facing the second waveguide circuit and a matching recess in the flange of said second circuit.

3. A releasable interconnection for two waveguide circuits according to claim 1 in which said cylindrical sleeve has one radial slot for laterally inserting said sleeve around said waveguide.

4. A releasable interconnection for two waveguide circuits according to claim 1 in which said cylindrical sleeve is made of two parts mounted on both sides of said waveguide.

5. A releasable interconnection for two waveguide circuits according to claim 1 in which said second waveguide is terminated by a rectangular flange and said base is fastened to said flange.

6. A releasable interconnection for two waveguide circits according to claim 1 in which both waveguides are terminated by a standard flange in which said base is set to the rear face of the flange of said second waveguide circuit by means of a circular plate provided with a central opening for the waveguide.

* * * * *